US007025123B1

(12) United States Patent
Gerndt et al.

(10) Patent No.: US 7,025,123 B1
(45) Date of Patent: Apr. 11, 2006

(54) FLUID DISTRIBUTION SYSTEM FOR THERMAL TRANSFER ROLLERS

(75) Inventors: Robert James Gerndt, Roswell, GA (US); John Joseph Sayovitz, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 168 days.

(21) Appl. No.: 09/240,524

(22) Filed: Jan. 29, 1999

(51) Int. Cl.
*F28F 5/02* (2006.01)
*F28D 11/02* (2006.01)

(52) U.S. Cl. ..... 165/90; 492/44; 492/46; 34/124; 432/116

(58) Field of Classification Search ..... 165/89, 165/90; 492/46, 44; 34/124; 432/116
See application file for complete search history.

(56) References Cited

U.S. PATENT DOCUMENTS

| | | | | | |
|---|---|---|---|---|---|
| 1,837,562 | A | * | 12/1931 | Mayer | 165/89 |
| 1,899,256 | A | * | 2/1933 | Brannen | 165/90 |
| 2,783,977 | A | | 3/1957 | Seanor | |
| 3,135,319 | A | | 6/1964 | Richards | 165/89 |
| 3,228,462 | A | | 1/1966 | Smith, Jr. | 165/89 |
| 3,338,992 | A | | 8/1967 | Kinney | 264/24 |
| 3,341,394 | A | | 9/1967 | Kinney | 161/72 |
| 3,502,538 | A | | 3/1970 | Petersen | 161/150 |
| 3,502,763 | A | | 3/1970 | Hartmann | 264/210 |
| 3,542,615 | A | | 11/1970 | Dobo et al. | 156/181 |
| 3,625,280 | A | * | 12/1971 | Frito | 165/90 |
| 3,692,618 | A | | 9/1972 | Dorschner et al. | 161/72 |
| 3,752,227 | A | | 8/1973 | Bulson | 165/89 |
| 3,802,817 | A | | 4/1974 | Matsuki et al. | 425/66 |
| 3,849,241 | A | | 11/1974 | Butin et al. | 161/169 |
| 3,855,046 | A | | 12/1974 | Hansen et al. | 161/150 |
| 4,050,510 | A | | 9/1977 | Theysohn | 165/89 |
| 4,077,466 | A | | 3/1978 | Fleissner | 165/89 |
| 4,252,184 | A | | 2/1981 | Appel | 165/90 |
| 4,340,563 | A | | 7/1982 | Appel et al. | 264/518 |
| 4,351,386 | A | * | 9/1982 | Kobler | 165/89 |
| 4,658,486 | A | * | 4/1987 | Schönemann | 492/46 |
| 4,781,795 | A | * | 11/1988 | Miller | 165/90 |
| 4,805,690 | A | | 2/1989 | Minami et al. | 165/89 |
| 4,955,433 | A | | 9/1990 | Zaoralek | 165/89 |
| 5,292,298 | A | * | 3/1994 | Scannell | 492/46 |
| 5,370,177 | A | | 12/1994 | Fey et al. | 165/89 |
| 5,549,154 | A | | 8/1996 | Niskanen et al. | 165/89 |
| 5,655,596 | A | * | 8/1997 | Zaoralek | 165/89 |
| 5,887,644 | A | * | 3/1999 | Akiyoshi et al. | 492/46 |
| 5,899,264 | A | * | 5/1999 | Marschke | 492/46 |
| 5,983,993 | A | * | 11/1999 | Watson et al. | 165/90 |

FOREIGN PATENT DOCUMENTS

| | | | | |
|---|---|---|---|---|
| DE | 5866 | * | 9/1878 | 34/124 |
| DE | 587808 | * | 11/1933 | 165/89 |
| GB | 728687 | * | 4/1955 | 165/90 |
| GB | 839058 | | 6/1960 | |

* cited by examiner

*Primary Examiner*—Ljiljana Ciric
(74) *Attorney, Agent, or Firm*—Pauley Petersen & Erickson

(57) ABSTRACT

A thermal transfer roller includes a first end chamber in communication with a source of thermal transfer fluid, an annulus for receiving the fluid and facilitating thermal transfer to a substrate, and a second end chamber in communication with the annulus for receiving the spent thermal transfer fluid. At least one end chamber includes a plurality of channels, each channel having a wider end approaching the annulus and a narrower end away from the annulus. Preferably, the channels are present in both end chambers. The channels substantially reduce angular flow of the fluid caused by rotation of the roller, and help stabilize and maintain desired fluid volumes flowing through the roller as its velocity is increased.

21 Claims, 3 Drawing Sheets

FLUID DISTRIBUTION SYSTEM FOR THERMAL TRANSFER ROLLERS

FIELD OF THE INVENTION

This invention is directed to an improved fluid distribution apparatus, for thermal bonding rollers and other rollers which employ fluid to facilitate heat transfer to a substrate. The invention especially includes thermal transfer rollers which embody the improved distribution apparatus.

BACKGROUND OF THE INVENTION

Heated calender rollers, which use heated fluid flowing through their interiors, are known in the art. Similarly, chilled or quenching rollers often employ chilled fluid in their interiors. U.S. Pat. No. 4,050,510, issued to Theysohn, discloses a shell of chilled cast iron having a plurality of passages parallel to the axis of the shell. Two cast iron end structures support the two ends of the shell. A plurality of radial passages is provided in the end structures for guiding a heating medium such as steam outward to, and inward from, the passages in the shell.

U.S. Pat. No. 4,077,466, issued to Fleissner, discloses a heated roller having an outer cylindrical shell, an inner cylindrical shell, a wall defining an annular space between the two shells, partitions in the annular space for forming flow channels for a heating medium, and radially disposed channels in the ends of the shell for introducing and removing the heating medium to and from the flow channels. U.S. Pat. No. 3,135,319, issued to Richards, discloses a similar configuration in a leveling roller.

In a point bonding process for nonwoven materials, fabric is passed between two heated rollers that are nipped together under pressures of 100–1000 pounds per linear inch. Again, a common way of heating the rollers is to pass a heated heat transfer fluid through the roll journals at one or both ends, and through the annulus between an outer roll shell in contact with the nonwoven web, and an inner shell. The annulus channels the oil at high velocity (with a high heat transfer coefficient) along the inner surface of the outer shell. Commonly, disk shaped chambers at both ends of the shell are used to introduce and remove the heat transfer fluid in a radial direction between the roll journals and the annulus.

Rotation of the rolls at high velocity can cause the fluid in the end chambers to move in an angular or spiral fashion. Imparting and dissipating rotational energy in the fluid causes a disturbance in the fluid flow, resulting in a loss in fluid volume being pumped at a constant pumping pressure. There is a resulting loss in heat transfer, and a loss in bonding capability and speed.

Angular and spiral flow can be overcome by providing radially directed channels, as in the references discussed above. However, the disclosed channels are few, and are increasingly spaced apart as they approach the outer surface of the roller. Due to the spaces between the radial channels, the heat transfer fluid is not evenly distributed as it enters the annulus.

There is a need or desire for a fluid distribution system in a heated roller which substantially overcomes angular and spiral fluid motion while providing a substantially even distribution of heat transfer fluid to and from the annulus.

SUMMARY OF THE INVENTION

The present invention is directed to an improved fluid distribution apparatus for thermal transfer rollers, and to thermal transfer rollers which embody the fluid distribution apparatus. The fluid distribution apparatus substantially overcomes angular and spiral fluid motion in the end disk chambers, caused by rotation of the rollers. At the same time, the apparatus provides a substantially even fluid supply and distribution to the annulus.

The thermal transfer rollers may be heating or cooling rollers, and may operate using hot or cold thermal transfer fluids. Generally, the thermal transfer rollers will include an outer cylindrical shell which contacts the nonwoven web or other substrate being heated or cooled, an inner cylindrical shell, and an annulus between the inner and outer cylindrical shells through which heat transfer fluid may flow. The annulus may be entirely open (free of individual channels), or may include a plurality of individual channels which carry heat transfer fluid from one end to the other of the heat transfer roller. The heat transfer roller includes a roll journal on one or both ends provided with a passage for injecting and/or removing heat transfer fluid to and from the roller. A disk-shaped chamber is provided on one or both ends of the heat transfer roller for carrying heat transfer fluid between the corresponding roll journal and the annulus.

In accordance with the invention, the disk-shaped chambers on one or both ends are provided with a plurality of flow control channels which pass between the corresponding journal and the annulus. The channels have a wider end approaching the annulus, and a narrower end approaching the journal. Preferably, the channels are defined by substantially radially-projecting walls extending between the journal and the annulus. The radially-projecting walls may be provided by inserting an assembly of radially-projecting baffles into an open disk-shaped chamber on the roller end.

By providing channels which are wider toward the annulus and narrower toward the journal, the spacing between adjacent channels at the annulus can be substantially reduced and minimized. This feature permits the flow control apparatus to substantially reduce the angular and spiral flow of fluid within the end chamber or chambers, and to provide a substantially uniform and even distribution of fluid flow to the annulus.

DEFINITIONS

Figure 1:
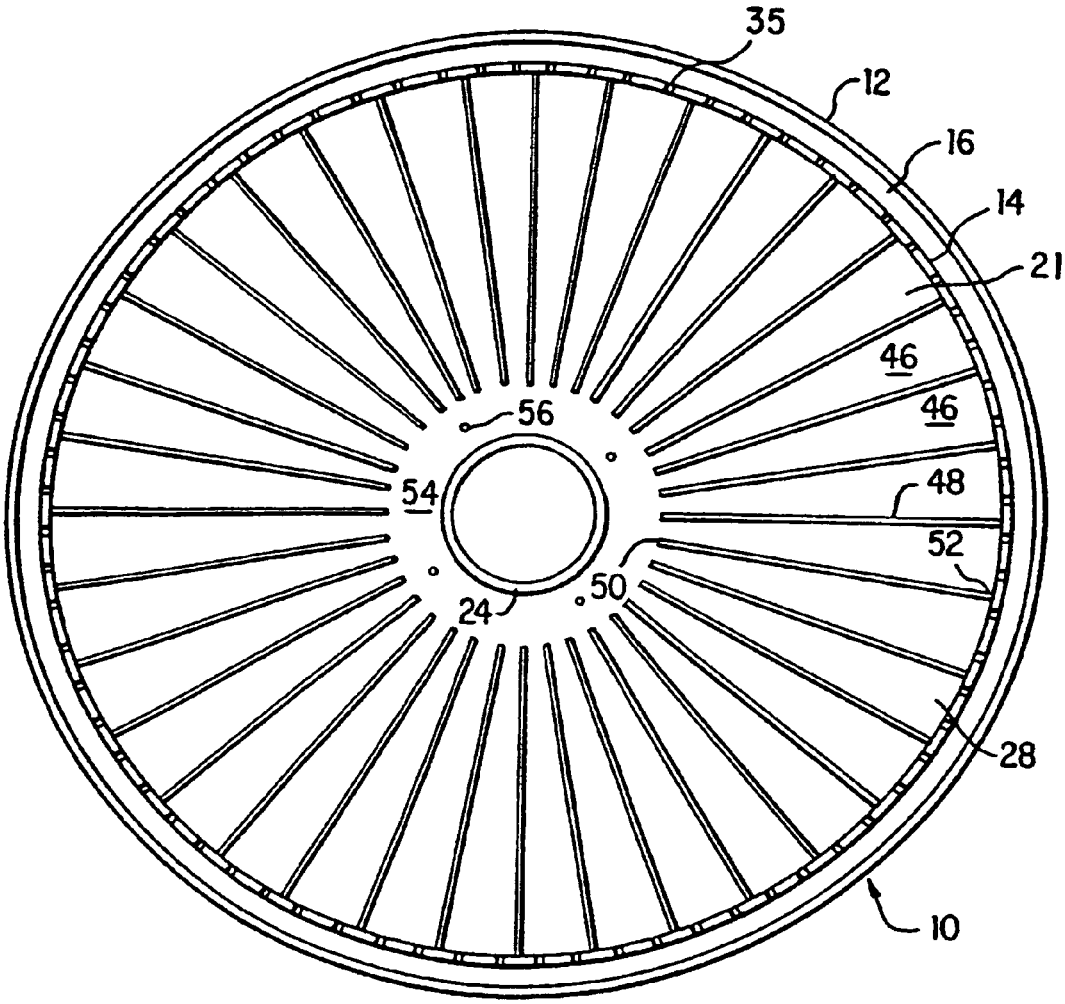
FIG. 1 is a schematic end view of a heat transfer roller of the invention, with the end cap removed to expose the end chamber and associated channels.

The term "nonwoven fabric or web" means a web having a structure of individual fibers or threads which are interlaid, but not in a regular or identifiable manner as in a knitted fabric. Nonwoven fabrics or webs have been formed from many processes such as, for example, meltblowing processes, spunbonding processes, air laying processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91.)

The term "spunbonded fibers" refers to small diameter fibers which are formed by extruding molten thermoplastic material as filaments from a plurality of fine capillaries of a spinnerette having a circular or other configuration, with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,502,538 to Petersen, and U.S. Pat. No. 3,542,615 to Dobo et al., each of which is incorporated herein in its entirety by reference. Spunbond fibers are quenched and generally not tacky when they are deposited onto a collecting surface. Spunbond fibers are generally continuous and often have average diameters larger than about 7 microns, more particularly, between about 10 and 30 microns.

The term "meltblown fibers" means fibers formed by extruding a molten thermoplastic material through a plurality of fine, usually circular, die capillaries as molten threads or filaments into converging high velocity heated gas (e.g., air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed for example, in U.S. Pat. No. 3,849,241 to Butin. Meltblown fibers are microfibers which may be continuous or discontinuous, are generally smaller than 10 microns in diameter, and are generally self bonding when deposited onto a collecting surface. Meltblown fibers are often substantially continuous in length.

The term "microfibers" means small diameter fibers having an average diameter not greater than about 75 microns, for example, having an average diameter of from about 1 micron to about 50 microns, or more particularly, having an average diameter of from about 1 micron to about 30 microns. Another frequently used expression of fiber diameter is denier, which is defined as grams per 9000 meters of a fiber. For a fiber having circular cross-section, denier may be calculated as fiber diameter in microns squared, multiplied by the density in grams/cc, multiplied by 0.00707. A lower denier indicates a finer fiber and a higher denier indicates a thicker or heavier fiber. For example, the diameter of a polypropylene fiber given as 15 microns may be converted to denier by squaring, multiplying the result by 0.89 g/cc and multiplying by 0.00707. Thus, a 15 micron polypropylene fiber has a denier of about 1.42 ($15^2 \times 0.89 \times 0.00707 = 1.415$). Outside the United States the unit of measurement is more commonly the "tex," which is defined as the grams per kilometer of fiber. Tex may be calculated as denier/9.

The term "polymer" includes, but is not limited to, homopolymers, copolymers, such as for example, block, graft, random and alternating copolymers, terpolymers, etc., and blends and modifications thereof. Furthermore, unless otherwise specifically limited, the term "polymer" shall include all possible geometrical configurations of the material. These configurations include, but are not limited to isotactic, syndiotactic and atactic symmetries.

The term "thermal point bonding" involves passing a fabric or web of fibers to be bonded between a heated calender roll and an anvil roll, which may also be heated. The calender roll is usually, though not always, patterned in some way so that the entire fabric is not bonded across its entire surface. As a result, various patterns for calender rolls have been developed for functional as well as aesthetic reasons. One example of a pattern has points and is the Hansen Pennings or "H&P" pattern with about a 30% bond area with about 200 bonds/square inch as taught in U.S. Pat. No. 3,855,046 to Hansen and Pennings. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5%. Another typical point bonding pattern is the expanded Hansen and Pennings or "EHP" bond pattern which produces a 15% bond area with a square pin having a side dimension of 0.037 inches (0.94 mm), a pin spacing of 0.097 inches (2.464 mm) and a depth of 0.039 inches (0.991 mm). Another typical point bonding pattern designated "714" has square pin bonding areas wherein each pin has a side dimension of 0.023 inches, a spacing of 0.062 inches (1.575 mm) between pins, and a depth of bonding of 0.033 inches (0.838 mm). The resulting pattern has a bonded area of about 15%. Yet another common pattern is the C-Star pattern which has a bond area of about 16.9%. The C-Star pattern has a cross-directional bar or "corduroy" design interrupted by shooting stars. Other common patterns include a diamond pattern with repeating and slightly offset diamonds and a wire weave pattern looking as the name suggests, e.g., like a window screen. Typically, the percent bonding area varies from around 10% to around 30% of the area of the fabric laminate web. As is well known in the art, the spot bonding holds the laminate layers together and imparts integrity to each individual layer by bonding filaments and/or fibers within each layer.

The terms "thermal transfer roller" and "heat transfer roller" are used interchangeably to refer to any roller which is used to impart heat or cooling to a substrate. Multiple thermal transfer rollers may be arranged in pairs, for example, two rollers nipped together, or may be separated and arranged in series. In a point bonding for nonwoven fabrics, the fabric may be passed between two heated thermal transfer rollers that are nipped together under pressure of about 100–1000 pounds per linear inch. Rollers used for cooling a substrate (i.e., chill rollers) are often separated and arranged in series. Thermal transfer rollers may be smooth, as in chill rollers, or patterned as in point bonding and embossing rollers. Smooth and patterned rollers may be used together in some applications.

The terms "thermal transfer fluid" and "heat transfer fluid" are used interchangeably to refer to fluids used to heat and cool thermal transfer rollers. Thermal transfer fluids include without limitation oil, water, steam, nitrogen, and various other organic and inorganic liquids and gases capable of effecting heat transfer needed for particular applications.

DETAILED DESCRIPTION OF THE PRESENTLY PREFERRED EMBODIMENTS

Figure 3:
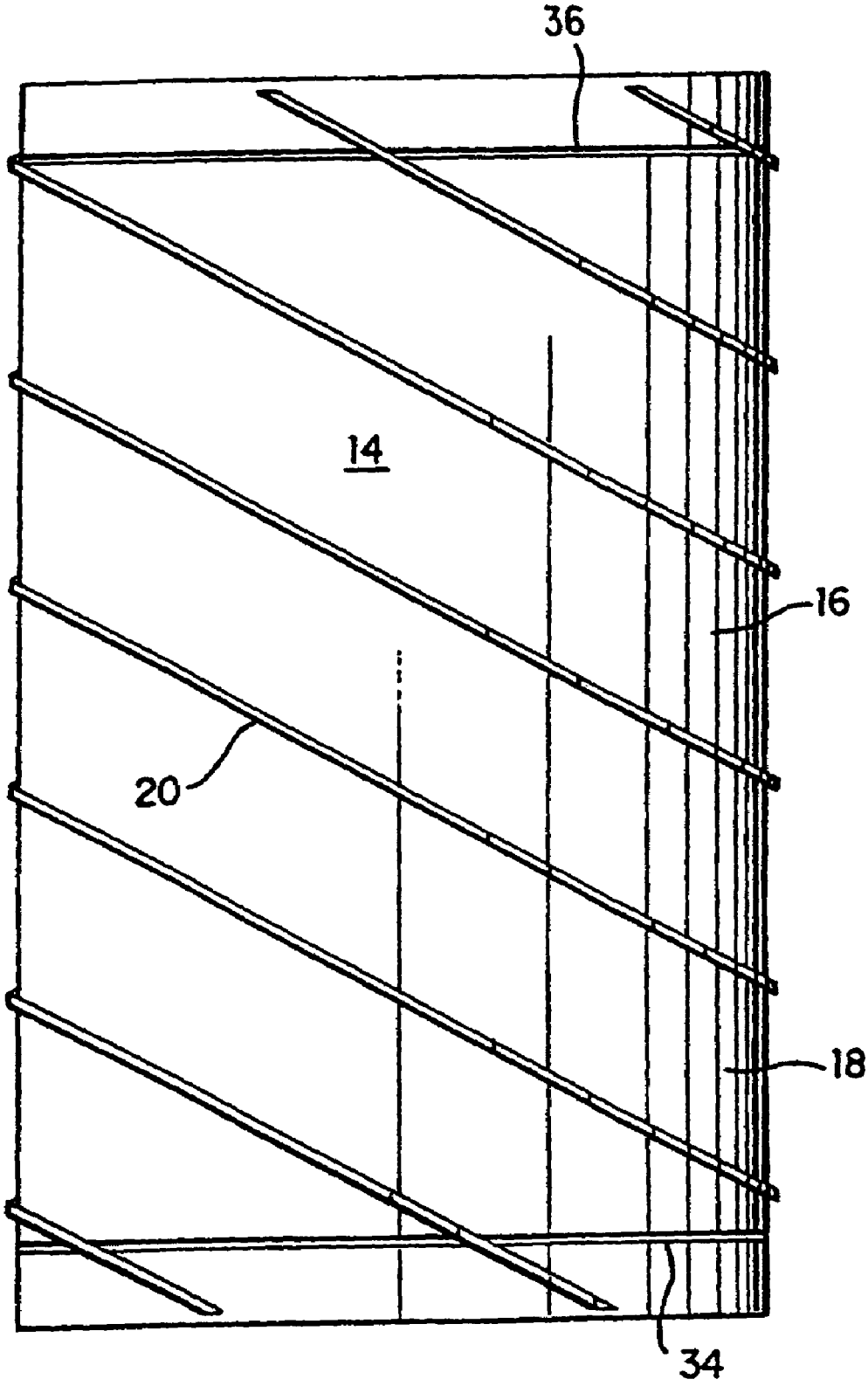
FIG. 3 schematically illustrates a channel configuration in the annulus, in one embodiment of the roller of the invention.

Referring to the drawings, where similar elements have the same reference numerals, a thermal transfer roller 10 of the invention includes an outer cylindrical shell 12 which contacts the nonwoven web or other substrate being heated or cooled, an inner cylindrical shell 14, and an annulus 16 between the inner and outer cylindrical shells through which heat transfer fluid may flow. The annulus 16 may be entirely open (free of individual channels), or may include a plurality of individual channels 18 as shown in FIG. 3, separated by spiral walls 20, which carry heat transfer fluid from a first end 21 to a second end 22 of the annulus and thermal transfer roller 10.

Figure 2:
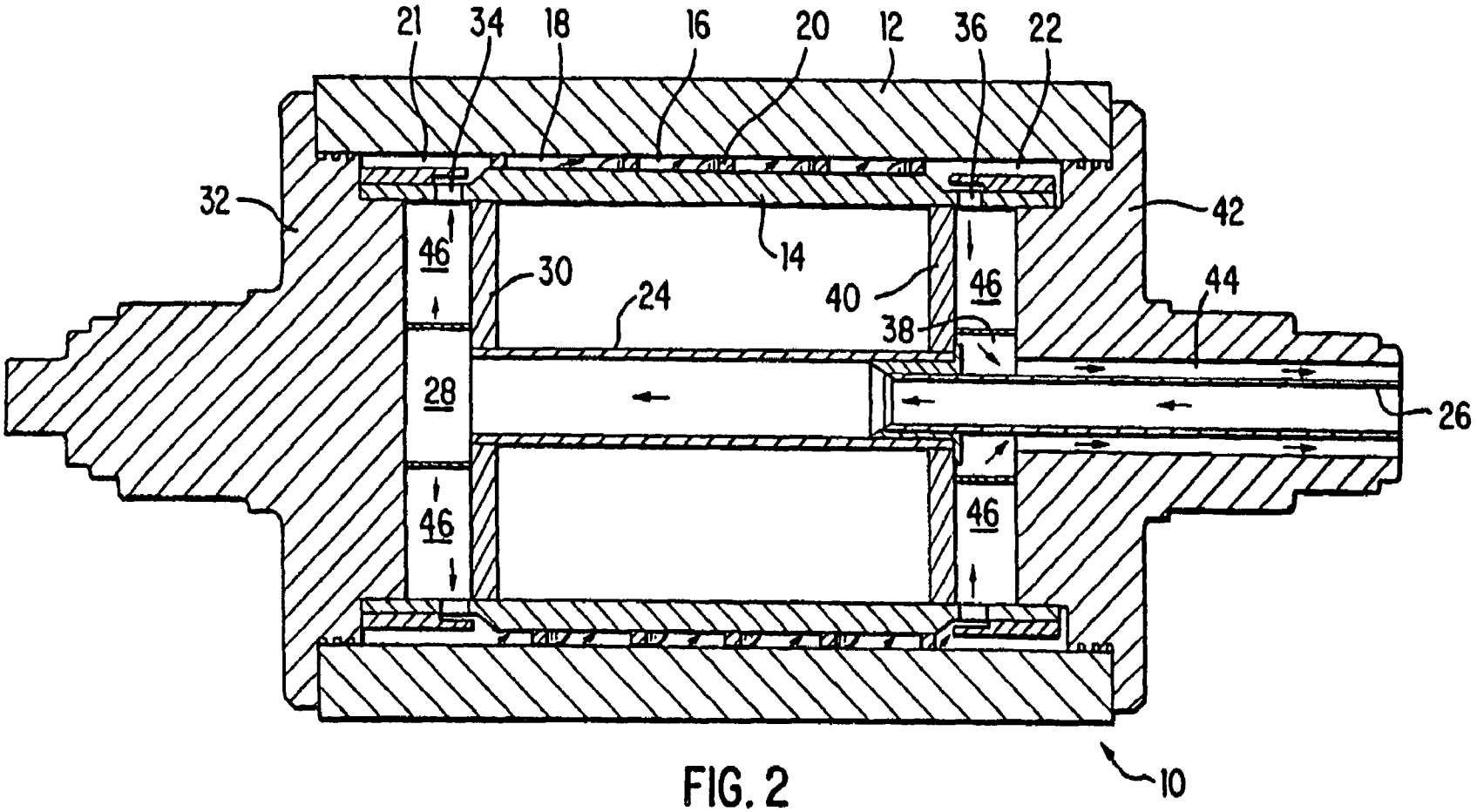
FIG. 2 is a front sectional view of a heat transfer roller of the invention.

Referring to FIG. 2, a hollow passage 24 extends along a central axis of the thermal transfer roller 10, and communicates at one end with an inlet channel 26 for heat transfer fluid, which supplies fluid to the passage 24 as shown by the arrows. In the embodiment shown, the passage 24 initially carries the fluid through the center of the roller from the second end 22 to the first end 21 thereof. A first disk-shaped chamber 28 at the first end 21 of the roller is defined between inner roller wall 30, first roll journal 32, and the cylindrical annulus 16. The first disk-shaped chamber 28, which is a fluid inlet chamber, carries heat transfer fluid from the passage 24 to the annulus 16, via a cylindrical fluid entry slot 34 (FIG. 2), or a plurality of smaller, individual fluid entry openings 35 (FIG. 1) formed in the inner cylindrical shell 14. The heat transfer fluid from inlet chamber 28 passes into and through the annulus 16 as the roller 10 is rotating, sometimes at high velocity, whereupon the heat transfer fluid heats (or cools) the outer cylindrical shell 12, which in turn conducts and transfers the heat (or cooling) to a substrate. In the embodiment shown, the heat transfer fluid circulates around the annulus 16 in a spiral flow pattern via channels 18.

The heat transfer fluid then exits the annulus 16 via a cylindrical fluid exit slot 36 (or a plurality of smaller openings 35) in the inner shell 14, and enters a second disk-shaped chamber 38, which is defined between inner roller wall 40, second roll journal 42, and the cylindrical annulus 16. The second disk-shaped chamber 38, which is a fluid outlet chamber, carries the spent heat transfer fluid to a cylindrical exit channel 44, which is defined between the second roll journal 42 and the wall of cylindrical inlet channel 26. The exit channel 44 carries the fluid to a heating or cooling device (not shown), which heats or cools the fluid as needed, for further use via the inlet channel 26.

Referring to FIG. 1, at least one end chamber 28 or 38 (and preferably both end chambers) is provided with a plurality of channels 46 between the passage 24 and the annulus 16. Each channel 46 has a wider end approaching the inner shell 14 and annulus 16, and a narrower end closer to the passage 24. The purpose of channels 46 is to substantially prevent the heat transfer fluid from assuming an angular or spiral flow pattern within the end chamber, particularly within the inlet chamber 28, due to rotation of the roller. Angular flow patterns in the end chambers (particularly inlet chamber 28) cause increased fluid pressure and reduce the volume of fluid delivered by a typical constant-pressure fluid pump. The tendency for angular or spiral fluid flow increases with roller velocity, causing further pressure increase and further reduction in fluid volume. By substantially reducing angular or spiral flow within the end chambers, the drop in fluid volume (and heat transfer) at higher roller velocities is substantially diminished.

The channels 46 are also designed to facilitate a substantially uniform, even discharge of fluid into cylindrical slot 34 entering the annulus 16 (FIG. 2) or into numerous smaller openings 35 entering the annulus 16 (FIG. 1). This is accomplished in part by providing channels 46 with a wider end approaching the annulus, and a narrower end approaching the passage 24. This configuration permits the channels to be immediately adjacent or very close to each other at both ends, and minimizes the amount of space not occupied by channels. By minimizing the distance between adjacent channels approaching the annulus, a substantially even fluid discharge around the circumference of the annulus is maintained.

In a preferred embodiment, the adjacent channels 46 are separated by relatively thin walls 48 which do not increase in thickness between their inner ends 50 near the passage 24 and their outer ends 52 near the annulus 16. For instance, the outer ends 52 of walls 48 may be connected by an imaginary line, which may be a circle. The imaginary line connecting the ends 52 should be occupied at least 70% by channels 46 and not more than 30% by walls 48 between the channels. Preferably, the imaginary line (defined in FIG. 1 by the inner surface of inner shell 14) will be occupied at least 80% by channels 46 and not more than 20% by walls 48, more preferably at least 90% by channels 46 and not more than 10% by thin walls 48.

The number of channels 46 around the circumference of the disk should be high enough to substantially prevent angular or spiral flow of heat transfer fluid in the end chambers. The end chamber should contain at least about ten of the channels 46, substantially evenly spaced. Preferably, the end chamber contains at least about 20 of the channels 46, more preferably at least about 30. If the channels 46 are too few in number, then angular flow of fluid within individual channels may occur to an undesirable degree.

Referring to FIG. 2, it is most important that the inlet chamber 28 be provided with individual channels 46, in order to provide substantially evenly-distributed axial fluid flow into the annulus. It is also desirable to provide the outlet chamber 38 with channels 46 to provide substantially evenly-distributed axial fluid flow from the annulus to the outlet channel 44. The preferred outlet chamber channels 46 are similar to the inlet chamber channels, and have a wider end approaching the annulus and a narrower end approaching the outlet channel 44.

Flow within the annulus 16 may occur in a spiral pattern, defined by the channels 18 and spiral walls 20 in FIG. 3. The spiral flow pattern within the annulus, which may proceed at an angle of around 30 degrees from the roller axis (in the embodiment shown) or at a different angle, helps to maximize heat transfer by facilitating an even and high degree of fluid fill, and high fluid velocity within the annulus 16.

The thermal transfer rollers of the invention have a wide variety of potential uses, including without limitation thermal point bonding, embossing, compressing and other heating of nonwoven polymer webs and films, and various cooling or quenching applications. Typically, the substrate may be a nonwoven web including a plurality of filaments made from one or more polymers. The nonwoven web may be a spunbond web, a meltblown web, a bonded carded web, or another type of nonwoven web, and may be present in a single-layer or multilayer composite including one or more nonwoven web layers. Paper may also be a substrate. The substrate may also be a thermoplastic film, or a thermoplastic film in combination with a nonwoven web, or with paper.

The substrate may be constructed from a wide variety of thermoplastic polymers, including without limitation polyamides, polyesters, polyolefins, copolymers of ethylene and propylene, copolymers of ethylene or propylene with a $C_4$–$C_{20}$ alpha-olefin, terpolymers of ethylene with propylene and a $C_4$–$C_{20}$ alpha-olefin, ethylene vinyl acetate copolymers, propylene vinyl acetate copolymers, styrene-poly(ethylene-alpha-olefin) elastomers, polyurethanes, A-B block copolymers where A is formed of poly(vinyl arene) moieties such as polystyrene and B is an elastomeric midblock such as a conjugated diene or lower alkene, polyethers, polyether esters, polyacrylates, ethylene alkyl acrylates, polyisobutylene, poly-1-butene, copolymers of poly-1-butene including ethylene-1-butene copolymers, polybutadiene, isobutylene-isoprene copolymers, and combinations of any of the foregoing. Polyolefins are common. Polyethylene and polypropylene homopolymers and copolymers are especially common. The substrate may have a wide variety of basis weights, preferably ranging from about 0.1 gram per square meter (gsm) to about 100 gsm.

The following examples illustrate the beneficial effects of the invention on maintaining high rates of fluid transfer through various rollers as the roll velocity is increased.

EXAMPLES

The following examples were performed using thermal transfer rollers similar to the one illustrated in FIG. 2. The rollers had an outer diameter of 36 inches, an outer diameter for the inner shell of about 27.5 inches, an annular thickness (distance between inner and outer shells) of about 0.28 inches, and an annular chamber length of about 151 inches. The annular chamber contained a series of thin spiral walls, each having a height of about 0.28 inches and an angle of 30 degrees from the longitudinal axis of the roller. The spiral walls defined flow channels in the annulus, each having a width of about 21.5 inches.

The inlet and outlet end chambers each had an axial thickness of about 7 inches and a diameter of about 23.5 inches. Fluid communication between the end chambers and the annulus was accomplished via seventy-two openings on each end of the inner shell, having diameters of 0.62 inch and spaced 5-degrees apart around the circumference at each end of the inner shell.

For some examples, a baffle assembly was mounted in each of the end chambers. Each baffle assembly included a back plate and thirty-six radially extending baffles, spaced 10 degrees apart from each other and defining thirty-six flow channels. When mounted, each baffle had an inner end about 3.75 inches from the central axis of the roller, and an outer end touching the inner surface of the inner cylindrical shell. Each baffle had a radial length of about 9 inches and an axial length of about 6.4 inches (slightly less than the axial length of the end chamber). The channels defined by the radially-extending baffles were wider approaching the annulus and narrower closer to the center of the roller. Each of the 36 chambers communicated with the annulus via two of the 72 openings in the inner shell.

Heat transfer oil (mixture of synthetic and natural hydrocarbons) was fed to the rollers using a constant pressure pump, and oil flow rates to the rollers were measured and recorded. The first two examples were performed using a single roller, with and without baffles. Table 1 shows the effect of roller velocity on the oil flow rate through the rollers.

TABLE 1

Oil Flow Rate vs. Rotational Speed of Roller

| Example No. | Baffles Inserted | Oil Flow Rate At: No Rotation | 108 RPM (1020 ft/min) | 275 RPM (2600 ft/min) |
|---|---|---|---|---|
| 1 | No | 570 gal/min | 493 gal/min | 210 gal/min |
| 2 | Yes | 540 gal/min | 535 gal/min | 485 gal/min |

As shown above, the flow rate of heat transfer oil declined 63% (from 570 GPM to 210 GPM) going from zero to 275 RPM, when no baffles were used to provide flow channels in the end chambers. With the baffles installed in both end chambers, the flow rate of heat transfer oil declined only 10% (from 540 GPM to 485 GPM) going from zero to 275 RPM.

For the next three examples, a similar evaluation was performed on a pair of nip rollers, consisting of a patterned roller and an anvil roller, used for the thermal point bonding of nonwoven fabrics. For Example 5, both rollers did not contain the baffle system (or other channeling apparatus) in the end chambers of either roller. For Example 6, the patterned roller did not contain the baffle system, but the anvil roller contained baffle systems in both the inlet and outlet chambers. For Example 7, both the patterned roller and the anvil roller contained baffle systems in both end chambers.

Again, heat transfer oil was fed to the rollers using the same constant pressure pump. Tables 2–4 show the effect of roller velocity on oil flow rate through each roller.

TABLE 2

Oil Flow Rate vs. Rotational (Linear) Speed of Dual Rollers, No Baffles

| Example No. | Roller | Baffles | Oil Flow rate (GPM) At: 100 ft/min | 2300 ft/min | 2400 ft/min | 2500 ft/min | 2600 ft/min | 2700 ft/min | 2800 ft/min |
|---|---|---|---|---|---|---|---|---|---|
| 5 | Patterned | No | 530 | 240 | 230 | 220 | 208 | 199 | 193 |
| | Anvil | No | 550 | 250 | 237 | 228 | 219 | 213 | 207 |

TABLE 3

| Oil Flow rate vs. Rotational (Linear) Speed of Dual Rollers, One With Baffles | | | | | | | |
|---|---|---|---|---|---|---|---|
| | | | Oil Flow rate (GPM) At: | | | | |
| Example No. | Roller | Baffles | No Rotation | 400 ft/min | 800 ft/min | 1020 ft/min | 2600 ft/min |
| 6 | Patterned | No | 570 | 560 | 513 | 493 | 210 |
| | Anvil | Yes | 540 | 536 | 535 | 535 | 485 |

TABLE 4

| Oil Flow Rate vs. Rotational (Linear) Speed of Dual Rollers, Both With Baffles | | | | | | | | |
|---|---|---|---|---|---|---|---|---|
| | | | Oil Flow Rate (GPM) At: | | | | | |
| Example No. | Roller | Baffles | No Rotation | 100 ft/min | 2600 ft/min | 2800 ft/min | 2900 ft/min | 3000 ft/min |
| 7 | Patterned | Yes | 515 | 540 | 511 | 510 | 510 | 510 |
| | Anvil | Yes | 510 | 550 | 498 | 496 | 495 | 493 |

In every situation where no baffles were used in a roller, the oil flow rate diminished greatly as the roller velocity was increased, especially at higher speeds. In every situation where baffles were used in a roller, the diminution in oil flow rate was orders of magnitude smaller.

While the embodiments of the invention described herein are presently preferred, various modifications and improvements can be made without departing from the spirit and scope of the invention. The scope of the invention is indicated by the appended claims, and all changes that fall within the meaning and range of equivalents are intended to be embraced therein.

What is claimed is:

1. A thermal transfer roller, comprising:

an outer shell and an inner shell coaxially positioned within the outer shell to define a continuous annulus between an inner surface of the outer shell and an outer surface of the inner shell;

a first end chamber and a second end chamber in fluid communication with the annulus, the first end chamber directing fluid to the annulus, the second end chamber directing fluid away from the annulus;

a passage in communication with the first end chamber, the passage extending the entire distance between the first end chamber and the second end chamber through a center of the thermal transfer roller a plurality of inlet channels in the first end chamber, each inlet channel having a first end closer to the passage and a second end closer to the annulus;

wherein each inlet channel becomes progressively wider from the first end of the inlet channel to the second end of the inlet channel a plurality of outlet channels in the second end chamber, each outlet channel having a first end closer to the annulus and a second end; wherein the first end of each outlet channel is wider than the second end of the outlet channel.

2. The thermal transfer roller of claim 1, wherein the first end chamber comprises a plurality of radially extending walls defining the inlet channels.

3. The thermal transfer roller of claim 1, wherein the first end chamber comprises an insert including a plurality of baffles defining the inlet channels.

4. The thermal transfer roller of claim 1, wherein the first end chamber comprises at least thirty of the inlet channels.

5. The thermal transfer roller of claim 1, wherein the second end chamber comprises a plurality of radially extending walls.

6. The thermal transfer roller of claim 1, wherein the second end chamber comprises an insert including a plurality of baffles.

7. The thermal transfer roller of claim 1, wherein the outlet second end chamber comprises at least ten of the outlet channels.

8. The thermal transfer roller of claim 1, wherein the second end chamber comprises at least twenty of the outlet channels.

9. The thermal transfer roller of claim 1, wherein the second end chamber comprises at least thirty of the outlet channels.

10. The thermal transfer roller of claim 1, wherein the annulus comprises at least one spiral channel.

11. The thermal transfer roller of claim 1, wherein the first end chamber comprises at least ten of the inlet channels.

12. The thermal transfer roller of claim 1, wherein the first end chamber comprises at least twenty of the inlet channels.

13. A thermal transfer roller, comprising:

an outer shell and an inner shell coaxially positioned within the outer shell to define a continuous annulus between an inner surface of the outer shell and an outer surface of the inner shell;

a first end chamber positioned at a first end of the thermal transfer roller and in communication with the annulus;

at least twenty inlet channels in the first end chamber, each having a wider end closer to the annulus and a narrower end further away from the annulus, wherein each inlet channel becomes progressively wider from the narrower end to the wider end thereof;

a second end chamber positioned at a second end of the thermal transfer roller and in communication with the annulus;

a plurality of outlet channels in the second end chamber, each having a wider end closer to the annulus and a narrower end further away from the annulus, wherein each outlet channel becomes progressively wider from the narrower end to the wider end thereof; and a passage in communication with the first end chamber, the passage extending the entire distance between the first end chamber and the second end chamber through a center of the thermal transfer roller.

14. The thermal transfer roller of claim 13, comprising at least ten of the outlet channels in the second end chamber.

15. The thermal transfer roller of claim 13, comprising at least twenty of the outlet channels in the second end chamber.

16. The thermal transfer roller of claim 13, comprising at least thirty of the inlet channels in the first end chamber.

17. The thermal transfer roller of claim 13, comprising radially extending walls in each end chamber which define the inlet and outlet channels.

18. The thermal transfer roller of claim 13, comprising a baffle insert in each end chamber, defining the inlet and outlet channels.

19. A roller assembly including a thermal transfer roller, the thermal transfer roller comprising:

a first end chamber in communication with a source of fluid;

a continuous annulus in communication with the first end chamber, the continuous annulus defined by an inner surface of an outer cylindrical shell and an outer surface of an inner cylindrical shell;

a plurality inlet channels in the first end chamber, each inlet channel having a wider end closer to the annulus, and a narrower end, wherein adjacent inlet channels are separated by a wall having a substantially uniform thickness;

a second end chamber in communication with the annulus; and, a plurality of outlet channels in the second end chamber, each outlet channel having a wider end closer to the annulus, and a narrower end; and, a passage in communication with the first end chamber, the passage extending the entire distance between the first end chamber and the second end chamber through a center of the thermal transfer roller.

20. The roller assembly of claim 19, further comprising a second roller.

21. The roller assembly of claim 19, comprising at least two of said thermal transfer rollers.

* * * * *

UNITED STATES PATENT AND TRADEMARK OFFICE

CERTIFICATE OF CORRECTION

PATENT NO. : 7,025,123 B1
APPLICATION NO. : 09/240524
DATED : April 11, 2006
INVENTOR(S) : Robert James Gerndt et al.

It is certified that error appears in the above-identified patent and that said Letters Patent is hereby corrected as shown below:

Column 9, line 53, Claim 1, after the word "roller" insert -- ; --.

Column 9, line 59, Claim 1, after the words "inlet channel" insert -- ; -- and begin a new paragraph.

Column 9, line 61, Claim 1, after the word "end;" begin a new paragraph.

Column 12, line 13, Claim 19, after ";" delete the word "and," and begin a new paragraph.

Signed and Sealed this

Eighth Day of August, 2006

JON W. DUDAS
*Director of the United States Patent and Trademark Office*